US010687609B2

(12) United States Patent
Waguespack

(10) Patent No.: US 10,687,609 B2
(45) Date of Patent: Jun. 23, 2020

(54) ORAL CARE IMPLEMENT

(71) Applicant: COLGATE-PALMOLIVE COMPANY, New York, NY (US)

(72) Inventor: Kenneth Waguespack, North Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 436 days.

(21) Appl. No.: 15/328,105

(22) PCT Filed: Jul. 23, 2014

(86) PCT No.: PCT/US2014/047812
§ 371 (c)(1),
(2) Date: Jan. 23, 2017

(87) PCT Pub. No.: WO2016/014051
PCT Pub. Date: Jan. 28, 2016

(65) Prior Publication Data
US 2017/0215567 A1 Aug. 3, 2017

(51) Int. Cl.
*A46B 9/02* (2006.01)
*A46B 9/04* (2006.01)
(Continued)

(52) U.S. Cl.
CPC ..... *A46B 9/025* (2013.01); *A46B 9/04* (2013.01); *A46B 9/06* (2013.01); *A46B 9/065* (2013.01);
(Continued)

(58) Field of Classification Search
CPC .. A46B 9/025; A46B 9/04; A46B 9/06; A46B 9/065; A46B 9/12; A46B 2200/1066; A46D 1/0276
See application file for complete search history.

(56) References Cited

U.S. PATENT DOCUMENTS 560,663 A 5/1896 Wallas
1,598,224 A 8/1926 Sant
(Continued)

FOREIGN PATENT DOCUMENTS

DE 10 2007 006 950 8/2008
EP 1793763 6/2007
(Continued)

OTHER PUBLICATIONS

International Search Report and the Written Opinion of the International Searching Authority issued in international application PCT/US2014/047812 dated Jun. 5, 2015.
(Continued)

*Primary Examiner* — Weilun Lo

(57) ABSTRACT

An oral care implement having an arrangement of different types of cleaning elements. Specifically, in one embodiment the oral care implement includes a head and a plurality of tooth cleaning elements. The tooth cleaning elements include a plurality of inclined bristle tufts that are circumferentially arranged about a reference ring. The inclined bristle tufts extend from the head so as to converge towards a reference axis with increasing distance from the head. The tooth cleaning elements also include an elastomeric member extending from the head within the reference ring. The elastomeric member may be conical in shape and have an inclined outer surface. In some embodiments the elastomeric member may include two components that are separated by a gap, and a central cleaning element may be located within the gap.

12 Claims, 5 Drawing Sheets

(51) Int. Cl.
*A46B 9/06* (2006.01)
*A46B 9/12* (2006.01)
*A46D 1/00* (2006.01)

(52) U.S. Cl.
CPC ..... *A46B 9/12* (2013.01); *A46D 1/0276* (2013.01); *A46B 2200/1066* (2013.01)

(56) References Cited

U.S. PATENT DOCUMENTS

| | | | | |
|---|---|---|---|---|
| 2,209,173 | A | 7/1940 | Young | |
| 2,476,201 | A | 7/1949 | Ligoure | |
| 4,081,877 | A | 4/1978 | Vitale | |
| 4,570,282 | A | 2/1986 | Kaufman et al. | |
| 4,729,142 | A | 3/1988 | Yoshioka | |
| 5,042,107 | A | 8/1991 | Gregory et al. | |
| 6,665,901 | B2 | 12/2003 | Driesen et al. | |
| 8,042,217 | B2 | 10/2011 | Sorrentino | |
| 8,434,190 | B2 | 5/2013 | Stief et al. | |
| 8,813,299 | B2 | 8/2014 | Garbers et al. | |
| 9,445,660 | B2 | 9/2016 | Mintel et al. | |
| 10,405,641 | B2 * | 9/2019 | Waguespack | A46B 3/06 |
| 2002/0166188 | A1 | 11/2002 | Driesen et al. | |
| 2004/0154112 | A1 | 8/2004 | Brown | |
| 2005/0039279 | A1 * | 2/2005 | Koeth | A46B 5/0025 15/167.1 |
| 2005/0071940 | A1 | 4/2005 | Hohlbein et al. | |
| 2005/0172436 | A1 | 8/2005 | Wineberg | |
| 2006/0117506 | A1 * | 6/2006 | Gavney, Jr. | A61C 17/3436 15/22.1 |
| 2011/0047736 | A1 * | 3/2011 | Jimenez | A46B 9/04 15/167.2 |
| 2011/0138563 | A1 | 6/2011 | Phgura | |
| 2013/0291320 | A1 * | 11/2013 | Kirchhofer | A46D 3/005 15/22.1 |
| 2014/0359959 | A1 * | 12/2014 | Jungnickel | A46B 9/04 15/167.1 |
| 2015/0082564 | A1 * | 3/2015 | Buchholz | A46B 9/04 15/105 |

FOREIGN PATENT DOCUMENTS

| | | |
|---|---|---|
| FR | 2 502 918 | 10/1982 |
| WO | 2004/071237 | 8/2004 |
| WO | 2010/007358 | 1/2010 |
| WO | WO 2010/023581 | 3/2010 |
| WO | 2010/069919 | 6/2010 |
| WO | 2012/015464 | 2/2012 |
| WO | 2013/005184 | 1/2013 |

OTHER PUBLICATIONS

Extended European Search Report issued in EP application No. 18214313.3 dated Apr. 23, 2019.

* cited by examiner

ORAL CARE IMPLEMENT

BACKGROUND

A toothbrush is used to clean the teeth by removing plaque and debris from the tooth surfaces. In typical oral care implements, bristles are bundled together in a bristle tuft and mounted within tuft holes. However, with new technologies now available, the use of bristles alone on a toothbrush is not optimal for the cleaning of teeth and other oral surfaces. Furthermore, conventional toothbrushes having a flat bristle trim are limited in their ability to conform to the curvature of the teeth, to penetrate into the interproximal areas between the teeth, to sweep away the plaque and debris, and to clean along the gum line. While substantial efforts have been made to modify the cleaning elements of toothbrushes to improve the efficiency of the oral cleaning process, the industry continues to pursue arrangements of cleaning elements that will improve upon the existing technology. Therefore, a need exists for an oral care implement having an improved arrangement of tooth cleaning elements.

BRIEF SUMMARY

The present invention may be directed, in one aspect, to an oral care implement having a head and a plurality of tooth cleaning elements. The tooth cleaning elements include a plurality of inclined bristle tufts that are circumferentially arranged about a reference ring. The inclined bristle tufts extend from the head so as to converge towards a reference axis with increasing distance from the head. The tooth cleaning elements also include an elastomeric member extending from the head within the reference ring. The elastomeric member may be conical in shape and have an inclined outer surface. In some embodiments the elastomeric member may include two components that are separated by a gap, and a central cleaning element may be located within the gap.

In one embodiment, the invention can be an oral care implement comprising: a head having a front surface; a plurality of tooth cleaning elements comprising: a plurality of inclined bristle tufts circumferentially arranged about a first reference ring on the front surface that surrounds a reference axis that intersects the front surface, each of the plurality of inclined bristle tufts extending from the front surface of the head so as to converge toward the reference axis with increasing distance from the front surface; and an elastomeric member extending from the front surface of the head at a position within the first reference ring.

Optionally, the first reference ring comprises a first center point, the reference axis is perpendicular to the front surface, and the reference axis intersects the front surface at the first center point of the first reference ring.

Optionally, the plurality of inclined bristle tufts terminate in free ends that collectively define a second reference ring.

Optionally, the second reference ring overlies the elastomeric member.

Optionally, the second reference ring comprises a second center point, the reference axis intersecting the second center point of the second reference ring.

Optionally, the first reference ring has a first diameter and the second reference ring has a second diameter, the second diameter being less than the first diameter.

Optionally, the elastomeric member terminates in a free end at a first height above the front surface; the plurality of inclined bristle tufts terminate in free ends at a second height above the front surface; and the second height is greater than the first height.

Optionally, the elastomeric member comprises an inclined outer surface that converges toward the reference axis with increasing distance from the front surface.

Optionally, an annular gap is formed between an outer surface of the elastomeric member and the plurality of inclined bristle tufts. Optionally, the annular gap has a constant width.

Optionally, the elastomeric member comprises a first component and a second component. Optionally, a central gap is formed between the first and second components of the elastomeric member; and the plurality of cleaning elements further comprises a central cleaning element extending from the front surface and located within the central gap. Optionally, the central cleaning element extends along the reference axis.

Optionally, the elastomeric member has a conical shape.

Optionally, each of the plurality of inclined bristle tufts comprises tapered bristles.

In another embodiment, the invention can be an oral care implement comprising: a head having a front surface; a plurality of tooth cleaning elements comprising: an elastomeric member extending from the front surface of the head, the elastomeric member extending along a reference plane that intersects the front surface; a plurality of first inclined bristle tufts arranged on a first side of the elastomeric member, each of the plurality of first inclined bristle tufts extending from the front surface of the head so as to converge toward the reference plane with increasing distance from the front surface; and a plurality of second inclined bristle tufts arranged on a second side of the elastomeric member opposite the first side, each of the plurality of second inclined bristle tufts extending from the front surface of the head so as to converge toward the reference plane with increasing distance from the front surface.

Optionally, the plurality of first inclined bristle tufts are arranged along a first linear reference line on the front surface of the head and the plurality of second inclined bristle tufts are arranged along a second linear reference line on the front surface of the head, the first linear reference line being parallel to the second linear reference line.

Optionally, the head comprises a longitudinal axis, the first and second linear reference lines being parallel to the longitudinal axis.

Optionally, the head comprises a longitudinal axis, the first and second linear reference lines being perpendicular to the longitudinal axis.

Optionally, the elastomeric member comprises a first component and a second component separated by a gap.

Optionally, the plurality of tooth cleaning elements further comprises a plurality of central cleaning elements extending from the front surface of the head along the reference plane.

Optionally, the reference plane is substantially perpendicular to the front surface of the head.

Optionally, the elastomeric member terminates in a free end at a first height above the front surface; the plurality of first and second inclined bristle tufts terminate in free ends at a second height above the front surface; and the second height is greater than the first height.

Optionally, the elastomeric member comprises a first outer surface adjacent the plurality of first inclined bristle tufts and a second outer surface adjacent the plurality of second inclined bristle tufts; and each of the first and second outer surfaces is inclined and converges toward the reference plane with increasing distance from the front surface.

Optionally, free ends of the plurality of first inclined bristle tufts terminate along a third linear reference line that overlies the elastomeric member; and free ends of the plurality of second inclined bristle tufts terminate along a fourth linear reference line that overlies the elastomeric member.

Optionally, each of the plurality of first inclined bristle tufts comprises tapered bristles; and each of the plurality of second inclined bristle tufts comprises tapered bristles.

In a further embodiment, the invention can be an oral care implement comprising: a head having a front surface; a plurality of tooth cleaning elements comprising: an elastomeric member extending from the front surface of the head; a first inclined bristle tuft arranged on a first side of the elastomeric member, the first inclined bristle tuft extending from the front surface of the head at an oblique angle toward the elastomeric member; and a second inclined bristle tuft arranged on a second side of the elastomeric member opposite the first side, the second inclined bristle tuft extending from the front surface of the head at an oblique angle toward the elastomeric member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
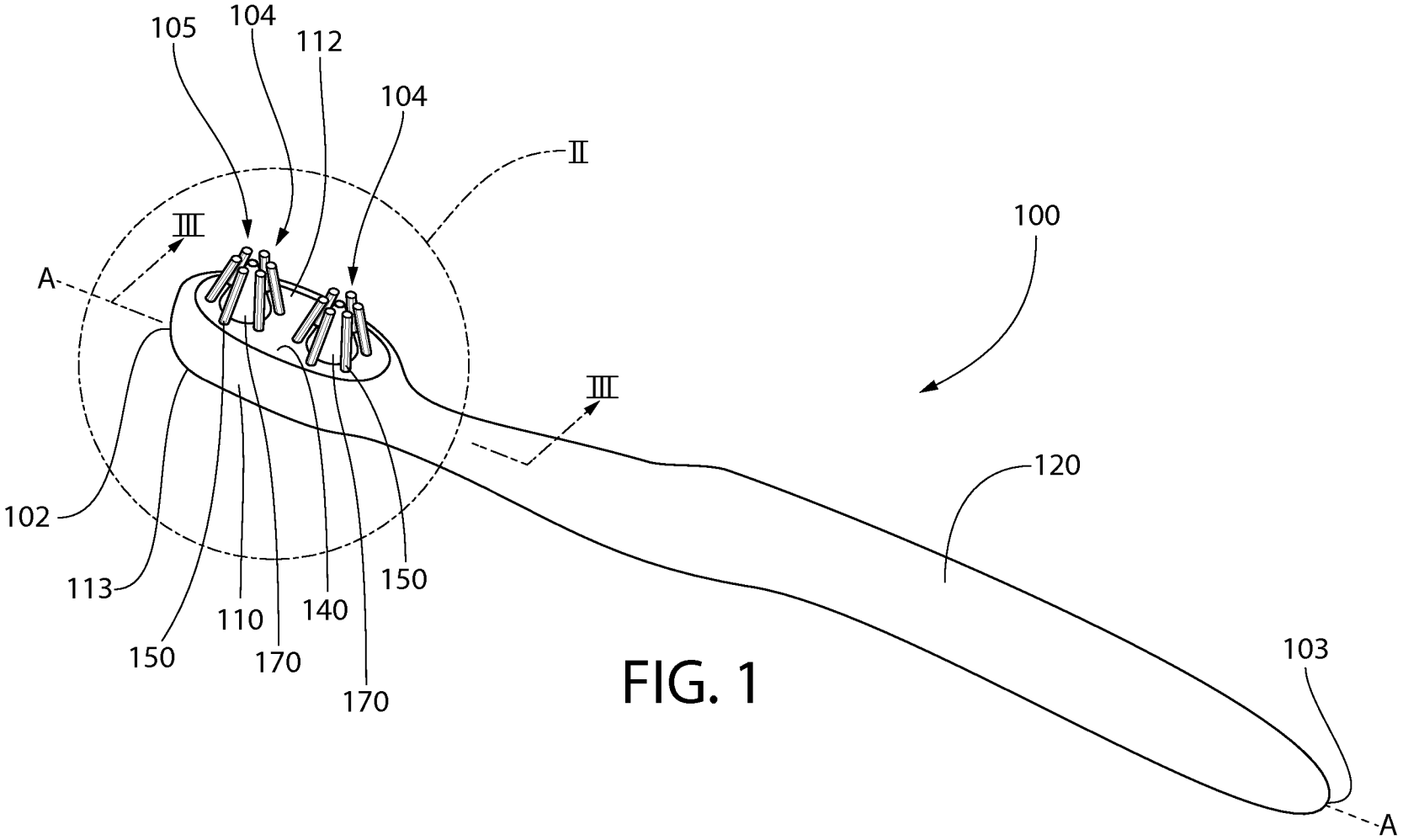
FIG. 1 is a front perspective view of an oral care implement in accordance with a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
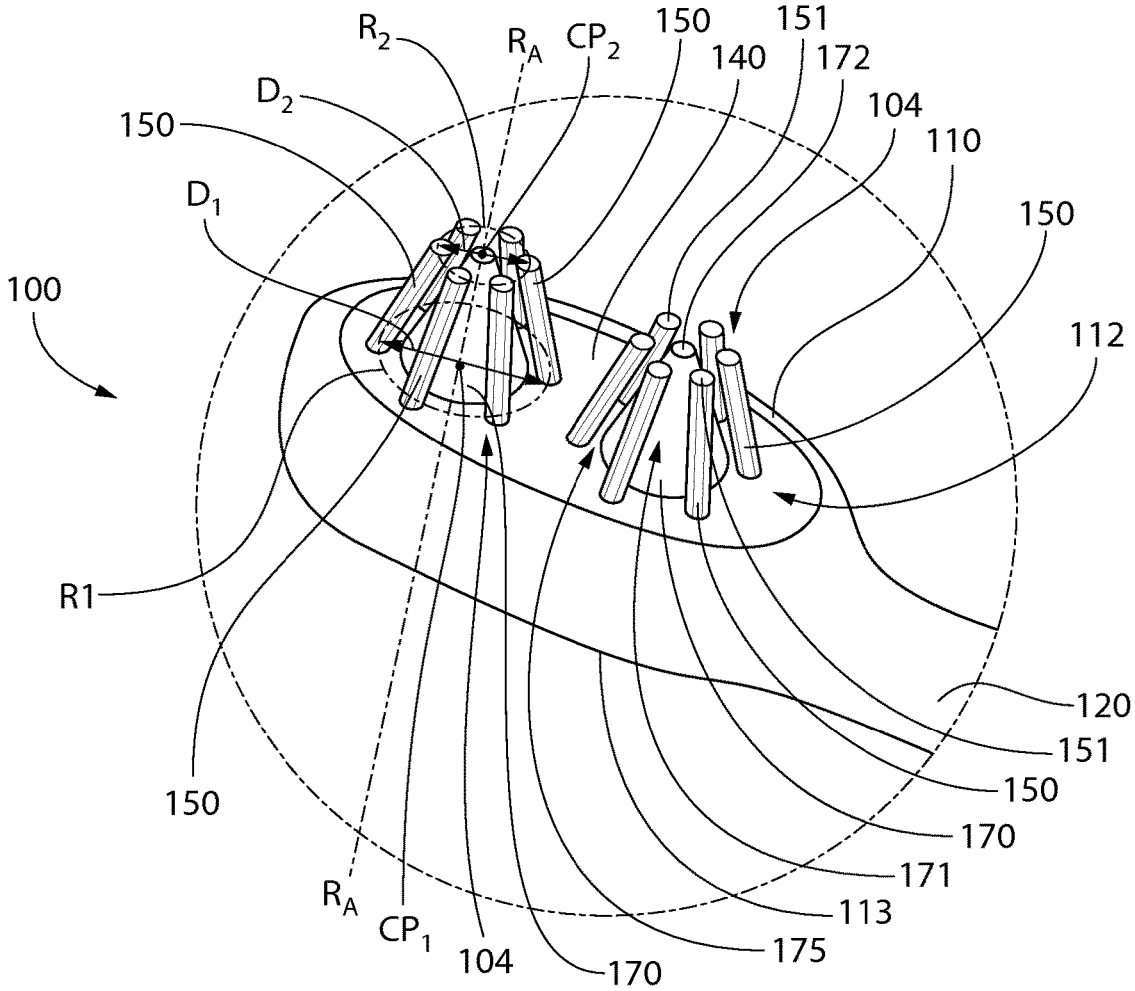
FIG. 2 is a close-up view of area II of FIG. 1.
Figure 3:
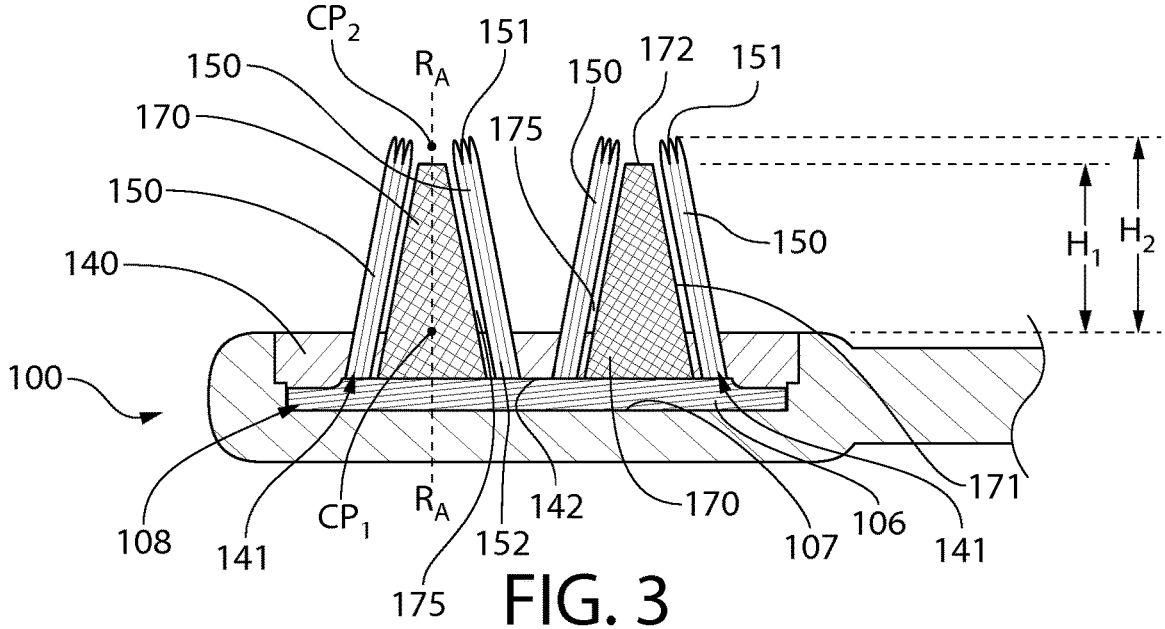
FIG. 3 is a cross-sectional view taken along line III-III in FIG. 1.

Referring to FIGS. 1-3 concurrently, an oral care implement 100 will be described in accordance with a first embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 103 to a distal end 102 along a longitudinal axis A-A. The oral care implement 100 generally includes a head 110 and a handle 120. The handle 120 is an elongated structure that provides the mechanism by which the user can hold and manipulate the oral care implement 100 during use. In the exemplified embodiment, the handle 120 is generically depicted having various contours for user comfort. Of course, the invention is not to be so limited in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds and polyesters such as polyethylene terephthalate. Furthermore, in certain embodiments the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used to form the handle 120 including metal, wood, or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 112 and an opposing rear surface 113. In the exemplified embodiment, the head 110 is formed integrally with the handle 120 as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In still other embodiments the head 110 may be detachably coupled to the handle 120 such that the head 110 may be replaceable.

In the exemplified embodiment, the head 110 of the oral care implement 100 is provided with a plurality of tooth cleaning elements 105 extending from the front surface 112. The specific details regarding the structure, pattern, orientation and material of the tooth cleaning elements 105 in accordance with some specific embodiments of the invention will be discussed in more detail below. As used herein, the term "tooth cleaning elements" may include any of various structures that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

In the exemplified embodiment, the tooth cleaning elements 105 are formed as a cleaning element assembly on a head plate 140 such that the tooth cleaning elements 105 are mounted onto the head plate 140 and then the head plate 140 is coupled to the head 110. In such an embodiment, the head plate 140 is a separate and distinct component from the head 110 of the oral care implement 100. However, the head plate 140 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 140 and the head 112 are separately formed components that are secured together during manufacture of the oral care implement 100.

In certain embodiments, the head plate 140 may comprise a plurality of holes 141 formed therethrough, and the tooth cleaning elements 105 may be mounted to the head plate 140 within the holes 141. This type of technique for mounting the tooth cleaning elements 105 to the head 110 via the head plate 140 is generally known as anchor free tufting (AFT). Specifically, in AFT a plate or membrane (i.e., the head plate 140) is created separately from the head 110. The tooth cleaning elements 105 (such as bristles, elastomeric elements, and combinations thereof) are positioned into the head plate 140 so as to extend through the holes 141 of the head plate 140. The free ends of the tooth cleaning elements 105 on one side of the head plate 140 perform the cleaning function. The ends of the tooth cleaning elements 105 on the other side of the head plate 140 are melted together by heat to be anchored in place. As the tooth cleaning elements 105 are melted together, a melt matte 106 is formed. After the tooth cleaning elements 105 are secured to the head plate 140, the head plate 140 is secured to the head 120 such as by ultrasonic welding. When the head plate 140 is coupled to the head 110, the melt matte 106 is located between a lower surface 142 of the head plate 140 and a floor 107 of a basin 108 of the head 110 in which the head plate 140 is disposed. The melt matte 106, which is coupled directly to and in fact forms a part of the tooth cleaning elements 105, prevents the tooth cleaning elements 105 from being pulled through the holes 141 in the head plate 140 to ensure that the tooth cleaning elements 105 remain attached to the head plate 140 during use of the oral care implement 100.

Of course, techniques other than AFT can be used for mounting the tooth cleaning elements 105 to the head 110, such as widely known and used stapling techniques or the like. In such embodiments the head plate 140 may be omitted and the tooth cleaning elements 105 may be coupled directly to the head 110. Furthermore, in a modified version of the AFT process discussed above, the head plate 140 may be formed by positioning the tooth cleaning elements 105 within a mold, and then molding the head plate 140 around the tooth cleaning elements 105 via an injection molding process.

Thus, in certain embodiments any suitable form of cleaning elements and attachment may be used in the broad practice of this invention. Specifically, the tooth cleaning elements 105 of the present invention can be connected to the head 120 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the tooth cleaning elements 105 could be mounted to tuft blocks or sections by extending through suitable openings in the tuft blocks so that the base of the tooth cleaning elements 105 is mounted within or below the tuft block.

Although not illustrated herein, in certain embodiments the head 110 may also include a soft tissue cleanser coupled to or positioned on its rear surface 113. An example of a suitable soft tissue cleanser that may be used with the present invention and positioned on the rear surface of the head 120 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Still referring to FIGS. 1-3 concurrently, the arrangement of the tooth cleaning elements 105 will be described. In the exemplified embodiment, the oral care implement 100 includes a plurality of tooth cleaning elements 105 that are arranged as two separate cleaning element units 104 that are longitudinally spaced apart from one another. Each of the units 104 is identical, and thus they will be described herein below together. Furthermore, although the invention is illustrated with two of the units 104, in certain embodiments the oral care implement 100 may include just one of the units 104, or the oral care implement 100 may include three or more of the units 104. Furthermore, although the units 104 are longitudinally aligned and spaced apart in the exemplified embodiment, in other embodiments the units 104 can be positioned at any other locations on the head 110, such as random, transverse alignment, or the like. In some embodiments the head 110 may be populated with several rows and columns of the units 104. Moreover, in some embodiments the oral care implement 100 may include additional tooth cleaning elements, such as bristles, elastomeric elements, or the like, that do not form a part of the units 104 but are positioned outside of and/or in between the units 104. Specifically, such additional tooth cleaning elements may be arranged along a perimeter of the head 110, in central regions of the head, or the like as desired. In some embodiments the oral care implement 100 may include one of the units 104, such as at the distal part of the head 110, and the proximal part of the head 110 can include additional tooth cleaning elements arranged in any desired configuration or pattern.

In the exemplified embodiment, the plurality of tooth cleaning elements 105 of each unit 104 comprises a plurality of inclined bristle tufts 150 (only some of which are labeled in the figures to avoid clutter) and an elastomeric member 170. As noted above, FIGS. 1-3 illustrate two units 104, each including a plurality of bristle tufts 150 and an elastomeric member 170. The following description is made with regard to one of the units 104, it being understood that the units 104 are identical to one another. The inclined bristle tufts 150 are tufts formed by clustering individual bristle strands together and inserting them into a common tuft hole on the head 110 (or on the head plate 140). The individual bristle strands that are used to form each tuft may be cylindrical bristles, spiral bristles, tapered bristles, fiber bristles, nylon bristles, filament bristles, or combinations thereof. For example, in one embodiment the inclined bristle tufts may be formed only with cylindrical bristles having rounded cleaning ends, only with spiral bristles, only with tapered bristles, or the like. In other embodiments, the inclined bristle tufts 150 may include combinations of cylindrical bristles having rounded cleaning ends, spiral bristles, and/or tapered bristles. Furthermore, in some embodiments at least two of the inclined bristle tufts 150 may include different combinations of one or more of cylindrical bristles having rounded cleaning ends, spiral bristles and/or tapered bristles.

Notwithstanding the above, in the exemplified embodiment, each of the plurality of inclined bristle tufts 150 comprises tapered bristles, as best illustrated in FIG. 3. Thus, in certain embodiments each of the plurality of inclined bristle tufts 150 includes at least some tapered bristles, although other bristles within each inclined bristle tuft 150 may be non-tapered. Furthermore, in still other embodiments each of the inclined bristle tufts 150 consists only of tapered bristles. Tapered bristles are bristles that taper to a pointed tip. The tapered bristles may taper along their entire length, or the tapered bristles may have a constant diameter for a first portion of their length and then taper for a second portion of their length. Tapering of the bristles can be achieved via mechanical grinding processes or via chemical dipping processes or a combination of the two.

The inclined bristle tufts 150 are positioned on the head 110 so as to be oriented at an oblique angle relative to the front surface 112 of the head 110. In the exemplified embodiment, the oblique angle is between 70° and 89°, more specifically between 75° and 85°, and still more specifically approximately 80° relative to the front surface 112 of the head 110. Of course, the oblique angle can be outside of the noted ranges in other embodiments, such as being angled between 91° and 110°, more specifically between 95° and 105°, and still more specifically approximately 100° relative to the front surface 112 of the head 110. Furthermore, the oblique angle can be greater than 110° in some embodiments and less than 70° in some embodiments as desired.

The inclined bristle tufts 150 are positioned on the head 110 so as to be circumferentially arranged about a first reference ring $R_1$ that is located on the front surface 112 of the head 110. Specifically, the first reference ring $R_1$ is not an actual structure on the head 110, but rather is delineated in the drawings in dotted lines to indicate a location or ring about which the inclined bristle tufts 150 are circumferentially arranged. The first reference ring $R_1$ surrounds a reference axis $R_A$ that intersects the front surface 112 of the head 110. More specifically, the first reference ring $R_1$ comprises a first center point $CP_1$. Furthermore, the reference axis $R_A$, which is oriented perpendicular to the front surface 112 of the head 110, intersects the front surface 112 of the head 110 at the first center point $CP_1$ of the first reference ring $R_1$.

In the exemplified embodiment, the first reference ring $R_1$ is circular in shape and has a closed geometry. However, the invention is not to be so limited in all embodiments and the first reference ring $R_1$ may have other polygonal shapes, such as being triangular, square, pentagonal, hexagonal, heptagonal, octagonal, or the like. Thus the reference ring can be any closed geometry boundary having any desired shape. Furthermore, in the exemplified embodiment the inclined bristle tufts 150 are circumferentially spaced apart from one another along the first reference ring $R_1$. More specifically, the inclined bristle tufts 150 are equi-distantly spaced apart from one another along the first reference ring $R_1$. However, the invention is not to be so limited in all embodiments and various amounts of spacing can be provided between adjacent ones of the inclined bristle tufts 150 in other embodiments. Additionally, in the exemplified embodiment the inclined bristle tufts 150 are positioned along the entirety of the closed polygon that is formed by the first reference ring $R_1$. However, in other embodiments the inclined bristle tufts 150 may be positioned along a first portion of the first reference ring $R_1$ while a second portion of the reference ring $R_1$ is devoid of any of the inclined bristle tufts 150. Stated another way, in certain embodiments the first reference ring $R_1$ may not form a closed polygon, but rather may form a portion of a ring (or other shape) and the inclined bristle tufts 150 may be circumferentially arranged about the portion of the ring (or other shape) formed by the first reference ring $R_1$.

The inclined bristle tufts 150 are referred to herein as being inclined due to their orientation at an oblique angle relative to the front surface 112 of the head 110 as discussed above. Specifically, each of the inclined bristle tufts 150 extends from the front surface 112 of the head 110 so as to converge toward the reference axis $R_A$ with increasing distance from the front surface 112 of the head 110. The inclined bristle tufts 150 extend from first ends 152 that are positioned within the tuft holes 141 and terminate in free ends 151. Due to the inclined nature of the inclined bristle tufts 150, the first ends 152 of the inclined bristle tufts 150 are located a greater linear distance from the reference axis $R_A$ than the free ends 151 of the inclined bristle tufts 150. Thus, the distance between two of the inclined bristle tufts 150 that are positioned diametrically opposed to one another decreases as the inclined bristle tufts 150 extend further from the front surface 112 of the head 110. In the exemplified embodiment the inclined bristle tufts 150 remain spaced apart from one another at their free ends 151. However, the invention is not to be so limited and in certain other embodiments the inclined bristle tufts 150 may converge towards each other so that the free ends 151 of the inclined bristle tufts 150 are in contact with one another. In still other embodiments the inclined bristle tufts 150 may crisscross at their free ends 151.

The free ends 151 of the plurality of inclined bristle tufts 150 collectively define a second reference ring $R_2$. Similar to the first reference ring $R_1$, the second reference ring $R_2$ is not an actual structure, but rather is delineated in the drawings in dotted lines to indicate a location or ring that is formed by tracing the collective free ends 151 of the inclined bristle tufts 150. In the exemplified embodiment, the second reference ring $R_2$ has an annular, ring-like shape and the second reference ring $R_2$ comprises a second center point $CP_2$. As with the first reference ring $R_1$, the second reference ring $R_2$ can have shapes other than circular in other embodiments. The reference axis $R_A$ intersects the second center point $CP_2$ of the second reference ring $R_2$. Thus, the reference axis $R_A$ intersects both the first center point $CP_1$ of the first reference ring $R_1$ and the second reference point $CP_2$ of the second reference ring $R_2$.

Furthermore, although the second reference ring $R_2$ is depicted as a circle or ring, in other embodiments the second reference ring $R_2$ can have any of the shapes as noted above with regard to the first reference ring $R_1$. Furthermore, in some embodiments the second reference ring $R_2$ may form an open polygon rather than a closed polygon. The first reference ring $R_1$ has a first diameter $D_1$ and the second reference ring $R_2$ has a second diameter $D_2$. Due to the converging/inclined orientation of the inclined bristle tufts 150, the first diameter $D_1$ is greater than the second diameter $D_2$. Thus, the spacing between diametrically opposing inclined bristle tufts 150 (and between adjacent inclined bristle tufts 150) is greater at the front surface 112 of the head 110 than at the free ends 151 of the inclined bristle tufts 151.

As noted above, the plurality of tooth cleaning elements 105 also includes the elastomeric member 170. Whereas the inclined bristle tufts 150 are formed from one or more of the various different types of bristle strands, the elastomeric member 170 is formed of an elastomeric material such that the elastomeric member 170 is resilient or flexible during use. In certain embodiments, the elastomeric member 170 may be formed of a thermoplastic elastomer. In some embodiments, the elastomeric member 170 may have a hardness property in the range of A8 to A25 Shore hardness. While the inclined bristles 150 can be used to scrub a user's teeth and other oral tissue surfaces, the elastomeric member 170 will wipe the user's teeth and other oral tissue surfaces. The combined effect of the inclined bristle tufts 150 and the elastomeric member 170 results in enhanced tooth and other oral tissue cleaning and polishing. Furthermore, the particular pattern and arrangement of the inclined bristle tufts 150 and elastomeric members 170 results in the oral care implement 100 more effectively cleaning tooth surfaces, interproximal regions, and along the gum line in a comfortable manner.

The elastomeric member 170 extends from the front surface 112 of the head 110 at a position within the first reference ring $R_1$. Specifically, the elastomeric member 170 is positioned entirely within the first reference ring $R_1$ such that no portion of the elastomeric member 170 protrudes beyond the bounds of the first reference ring $R_1$. Thus, the first reference ring $R_1$ circumferentially surrounds the elastomeric member 170 and the elastomeric member 170 is located within the space bounded by the first reference ring $R_1$. Similarly, because the inclined bristle tufts 150 are arranged along the first reference ring $R_1$, the inclined bristle tufts 150 circumferentially surround (at least partially) the elastomeric member 170. As can be seen in FIG. 3, each of the inclined bristle tufts 150 (each of which comprises a plurality of bristle strands or filaments/monofilaments) is positioned within its own separate tuft hole and the elastomeric member 170 is also positioned within its own individual tuft hole. All of the tuft holes are separate and isolated from one another such that there is no spatial communication between any two of the tuft holes of the inclined bristle tufts 150 or between any of the tuft holes of the inclined bristle tufts 150 and the tuft hole of the elastomeric member 170.

In the exemplified embodiment, the elastomeric member 170 has an inclined outer surface 171 that converges towards the reference axis $R_A$ with increasing distance from the front surface 112 of the head 110. Specifically, the elastomeric member 170 has a width that continually decreases with distance from the front surface 112 of the head 121 towards a free end 172 of the elastomeric member 170. Stated another way, the width of the elastomeric member 170 measured at the front surface 112 of the head 110 is greater than the width of the elastomeric member 170 measured at the free end 172 of the elastomeric member 170.

Thus, the outer surface 171 of the elastomeric member 170 is inclined relative to the front surface 112 of the head 110. In the exemplified embodiment the outer surface 171 of the elastomeric member 170 is oriented at an oblique angle relative to the front surface 112 of the head 110. In the exemplified embodiment, the oblique angle is between 70° and 89°, more specifically between 75° and 85°, and still more specifically approximately 80° relative to the front surface 112 of the head 110. Of course, the oblique angle can be outside of the noted ranges in other embodiments, such as being angled between 91° and 110°, more specifically between 95° and 105°, and still more specifically approximately 100° relative to the front surface 112 of the head 110. Furthermore, the oblique angle can be greater than 110° in some embodiments and less than 70° in some embodiments as desired.

Furthermore, in the exemplified embodiment the elastomeric member 170 has a conical shape, and more specifically a truncated conical shape in that the elastomeric member 170 does not terminate at a tip, but rather at the flattened top surface or free end 172. However, the invention is not to be so limited and the elastomeric member 170 may have a fully (as opposed to truncated) conical shape in other embodiments. Furthermore, the elastomeric member 170 can take on shapes other than conical so long as the outer surface 171 of the elastomeric member 170 is inclined/converges as noted herein above.

The elastomeric member 170 terminates in the free end 172 at a first height $H_1$ above the front surface 112 of the head 110. Furthermore, the plurality of inclined tufts 150 terminate in the free ends 151, which are located at a second height $H_2$ above the front surface 112 of the head 110. In the exemplified embodiment, the second height $H_2$ is greater than the first height $H_1$. Of course, the invention is not to be so limited in all embodiments and in certain other embodiments the second height $H_2$ may be less than or equal to the first height $H_1$. In certain embodiments in which tapered bristles are used in the inclined bristle tufts 150, it may be such that only tapered portions of the tapered bristles extend above the free end 172 of the elastomeric member 170. Furthermore, in some embodiments the bristles may begin to taper at a location of the bristle that is aligned with the free end 172 of the elastomeric member 170 such that portions of the bristles that are aligned with the body of the elastomeric member 170 are non-tapered.

As can be seen from the drawings, the second reference ring $R_2$ overlies the elastomeric member 170. Specifically, because the height $H_2$ is greater than the height $H_1$, the second reference ring $R_2$ collectively defined by the free ends 151 of the inclined bristle tufts 150 is above (taken from the perspective of the front surface 112 of the head 110) the elastomeric member 170. However, the second diameter $D_2$ of the second reference ring $R_2$ is less than the outermost diameter of the elastomeric member 170 (the diameter of the elastomeric member 170 decreases with distance from the front surface 112 of the head 110 due to the inclined nature of the outer surface 171 of the elastomeric member 170). Thus, the second reference ring $R_2$ can be said to overlie the elastomeric member 170. Stated another way, if the second reference ring $R_2$ were to extend in a ring-shaped plane downwardly from the free ends 151 of the inclined bristle tufts 150 towards the front surface 112 of the head 110 in a perpendicular manner, the ring-shaped plane would intersect the elastomeric member 170.

As noted above, the inclined bristle tufts 150 are arranged so as to circumferentially surround the elastomeric member 170 about the reference axis $R_A$. Furthermore, in the exemplified embodiment each of the inclined bristle tufts 150 is spaced apart from the elastomeric member 170 so that an annular gap 175 is present between the outer surface 171 of the elastomeric member 170 and the plurality of inclined bristle tufts 150. Furthermore, in the exemplified embodiment the plurality of inclined bristle tufts 150 and the outer surface 171 of the elastomeric member 170 are inclined at the same degree. As a result, the annular gap 175 has a constant width. Furthermore, as can be seen in FIG. 3, the annular gap 175 is also an inclined annular gap 175 having the same degree of incline as each of the outer surface 171 of the elastomeric member 170 and the plurality of inclined bristle tufts 150 as discussed above.

Figure 4:
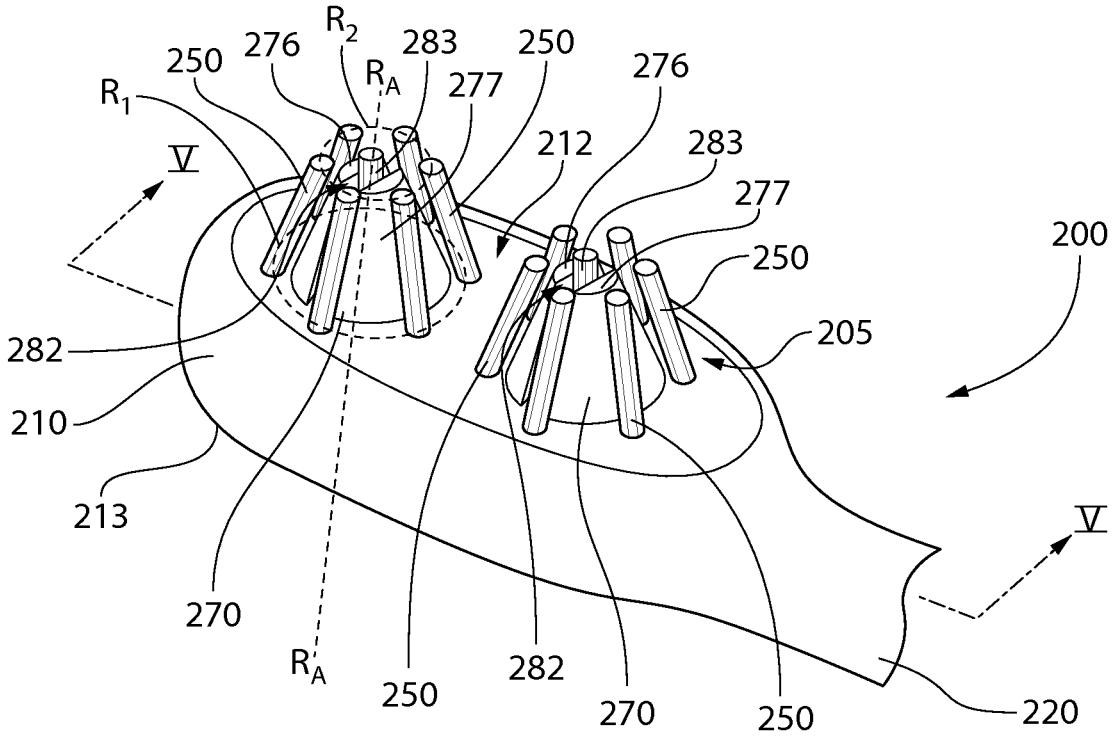
FIG. 4 is a close-up view of a head of an oral care implement in accordance with a second embodiment of the present invention.
Figure 5:
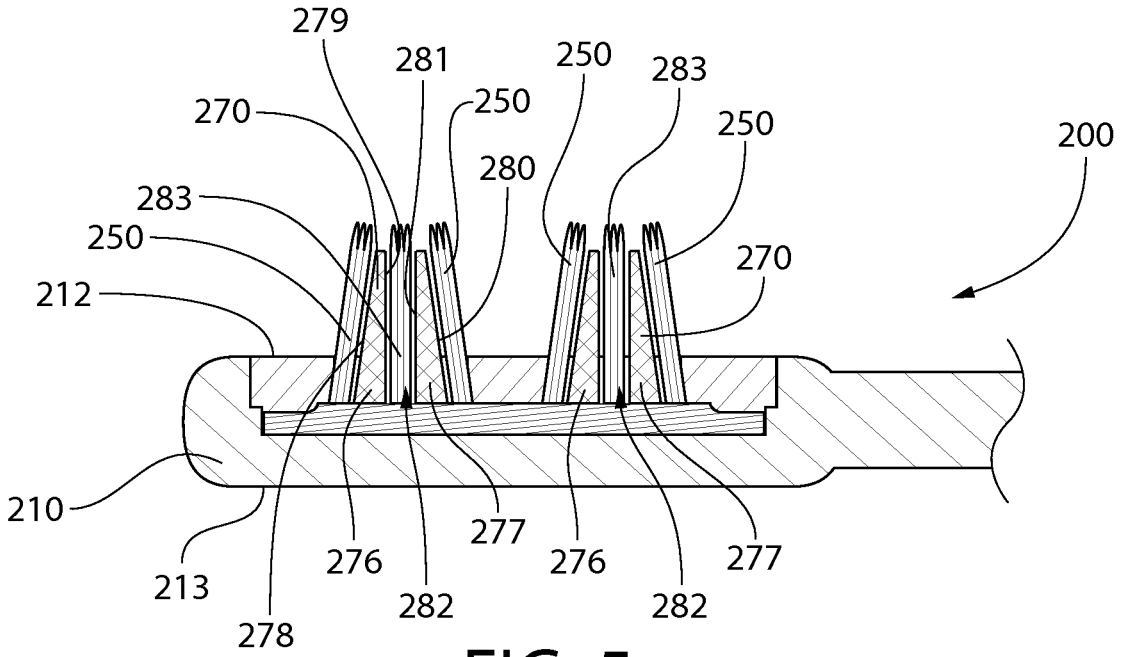
FIG. 5 is a cross-sectional view taken along line V-V of FIG. 4.

Referring now to FIGS. 4 and 5 concurrently, an oral care implement 200 will be described in accordance with a second embodiment of the present invention. The oral care implement 200 is similar to the oral care implement 100 and thus much of the description above with regard to the oral care implement 100 is applicable to the oral care implement 200, except where the description of the oral care implement 100 above is contradictory to a specific description of the oral care implement 200 provided below. Features of the oral care implement 200 that are similar to features of the oral care implement 100 described above will be similarly numbered except that the 200-series of numbers will be used. Certain features of the oral care implement 200 may be labeled but not described, in which case the description of the similar feature from the oral care implement 100 applies. Furthermore, certain features of the oral care implement 200 may not be labeled, it being understood that the description of the similar feature from the oral care implement 100 applies.

The oral care implement 200 generally comprises a head 210 and a handle 220. The head 210 has a front surface 212 and an opposing rear surface 213. Furthermore, a plurality of tooth cleaning elements 205 extend from the front surface 212 of the head 210. The plurality of tooth cleaning elements 205 comprises a plurality of inclined bristles 250 and an elastomeric member 270. The description provided above with regard to the material, type, positioning, orientation and the like of the inclined bristles 150 is equally applicable to the inclined bristles 250 and thus a duplicate description will not be provided herein.

The elastomeric member 270 has an overall conical shape similar to the elastomeric member 170 discussed above. However, in this embodiment the elastomeric member 270 comprises a first component 276 and a second component 277. The first component 276 of the elastomeric member 270 has an outer surface 278 and an inner surface 279. The second component 277 of the elastomeric member 270 has an outer surface 280 and an inner surface 281. In the exemplified embodiment, each of the first and second components 276, 277 forms a half of a cone or truncated cone. Thus, the outer surfaces 278, 280 of each of the first and second components 276, 277 of the elastomeric member 270 are inclined or oriented at an oblique angle relative to the front surface 212 of the head 210. Furthermore, in the exemplified embodiment the inner surfaces 279, 281 of each of the first and second components 276, 277 is oriented perpendicular to the front surface 212 of the head 210, although the inner surfaces 279, 281 of one or both of the first and second components 276, 277 can be angled relative to the front surface 212 of the head 210 if so desired in other embodiments.

In the exemplified embodiment, the first component 276 is spaced apart from the second component 277 by a central gap 282. More specifically, the inner surface 279 of the first component 276 is spaced apart from the inner surface 281 of the second component 277 by the central gap 282. In the exemplified embodiment, because each of the inner surfaces 279, 281 of the first and second components 276, 277 is oriented perpendicular to the front surface 212 of the head 210, the central gap 282 has a constant width.

In the exemplified embodiment, a central cleaning element 283 extends from the front surface 212 of the head 210 and is located within the central gap 282. As noted above, the plurality of inclined bristle tufts 250 are inclined relative to the front surface 212 of the head 210. In the exemplified embodiment the central cleaning element 283 is oriented substantially perpendicular relative to the front surface 212 of the head 210. Of course, the invention is not to be so limited in all embodiments and the central cleaning element 283 may be inclined or otherwise obliquely oriented relative to the front surface 212 of the head 210 in other embodiments.

Although the exemplified embodiment depicts a single bristle tuft forming the central cleaning element 283, in some embodiments multiple bristle tufts, each containing a plurality of individual bristle strands, may be positioned within the central gap 282. Furthermore, in the exemplified embodiment the central cleaning element 283 comprises a plurality of tapered bristles. As has been discussed above, the bristles that form the central cleaning element 283 can be spiral, cylindrical and rounded, or any other type of bristle. Alternatively, the central cleaning element 283 may be formed of an elastomeric material such that the central cleaning element 283 may be an elastomeric wall extending along a portion of or the entirety of the central gap 282.

Similar to the discussion of the oral care implement 100, the inclined bristle tufts 250 are circumferentially arranged about a first reference ring $R_1$ on the front surface 212 of the head 210. The first reference ring $R_1$ surrounds a reference axis $R_A$ that intersects the front surface 212 of the head 210. Furthermore, in this embodiment the central cleaning element 283 extends along the reference axis $R_A$. Stated another way, in the exemplified embodiment the reference axis $R_A$ intersects the central cleaning element 283. Furthermore, although the central cleaning element 283 is positioned within the central gap 282, in the exemplified embodiment there remains a gap or space between the central cleaning element 283 and the inner surfaces 279, 281 of each of the first and second components 276, 277 of the elastomeric member 270. However, in other embodiments the central cleaning element 283 may be in abutting surface contact with the inner surfaces 279, 281 of one or both of the first and second components 276, 277 along a part of or the entirety of the length of the first and second components 276, 277 of the elastomeric member 270.

Figure 6:
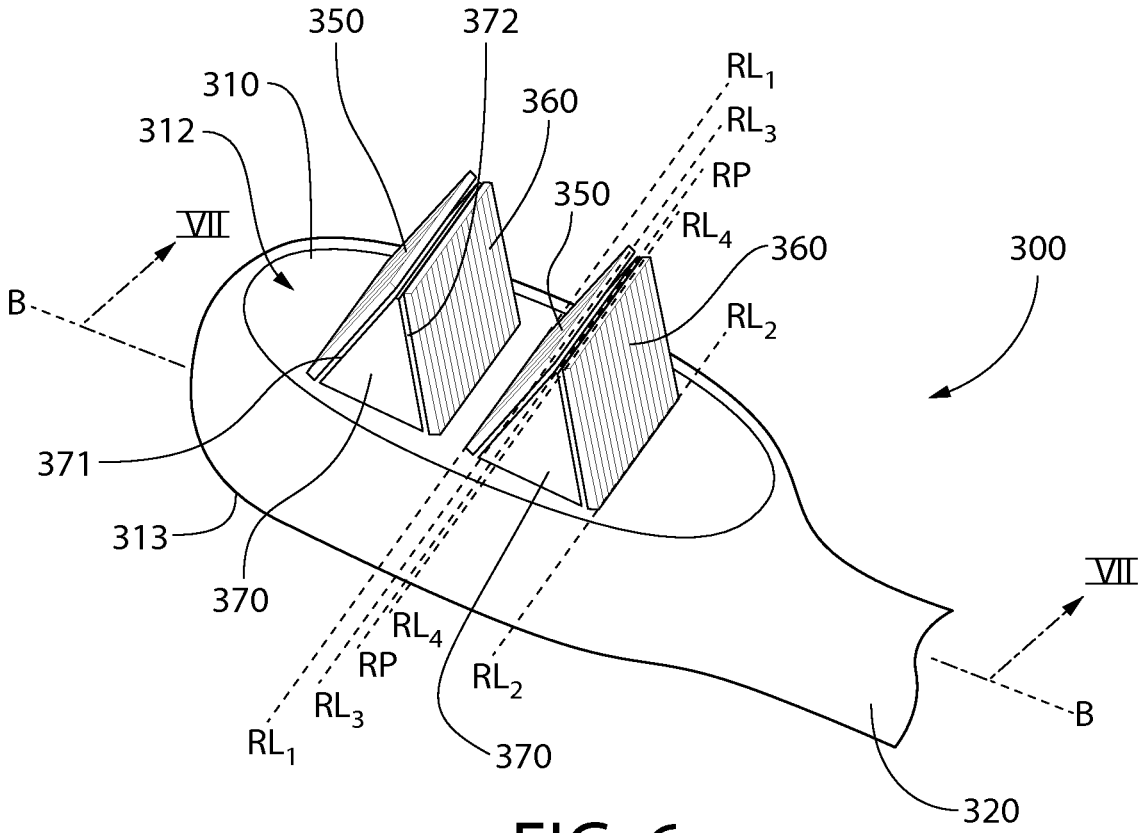
FIG. 6 is a close-up view of a head of an oral care implement in accordance with a third embodiment of the present invention.
Figure 7:
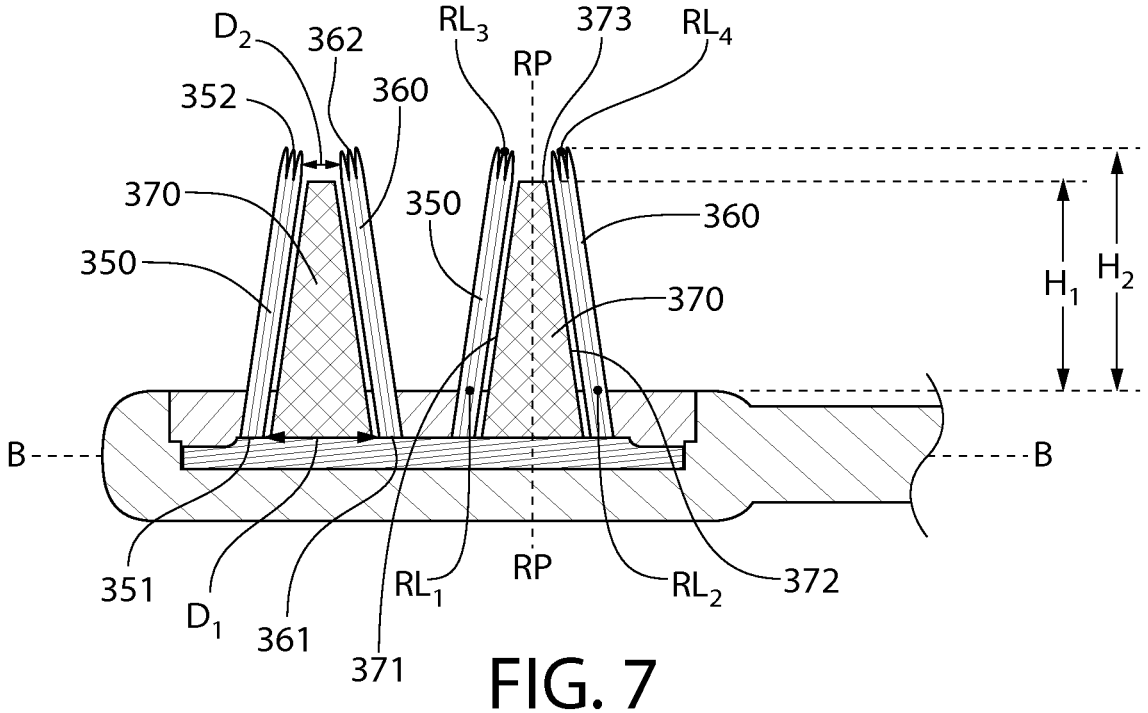
FIG. 7 is a cross-sectional view taken along line VII-VII of FIG. 6.

Referring now to FIGS. 6 and 7 concurrently, an oral care implement 300 will be described in accordance with a third embodiment of the present invention. The oral care implement 300 is similar to the oral care implements 100, 200 and thus much of the description above with regard to the oral care implements 100, 200 is applicable to the oral care implement 300, except where it is contradictory to a specific description of the oral care implement 300 provided below. Features of the oral care implement 300 that are similar to features of the oral care implements 100, 200 described above will be similarly numbered except that the 300-series of numbers will be used. Certain features of the oral care implement 300 may be labeled but not described, in which case the description of the similar feature from the oral care implements 100, 200 applies. Furthermore, certain features of the oral care implement 300 may not be labeled, it being understood that the description of the similar feature from the oral care implements 100, 200 applies.

The oral care implement 300 generally comprises a head 310 and a handle 320. The head 310 has a front surface 312 and an opposing rear surface 313. The head 310 extends along a longitudinal axis B-B. Furthermore, a plurality of tooth cleaning elements 305 extend from the front surface 312 of the head 310. The plurality of tooth cleaning elements 305 comprises a plurality of inclined bristles 350 and an elastomeric member 370. The description above with regard to the materials, angles, inclination, and the like with regard to the inclined bristle tufts 150 and the elastomeric member 170 are equally applicable to the inclined bristle tufts 350 and the elastomeric member 370 of the oral care implement 300. However, the inclined bristle tufts 350 and the elastomeric member 370 have different shapes and relative positioning than those same elements of the oral care implement 100, as discussed in more detail herein below.

Rather than being conical in shape as with the elastomeric member 170, in the exemplified embodiment the elastomeric member 370 is in the shape of a triangular prism. More specifically, in the exemplified embodiment the elastomeric member 370 is in the shape of a truncated triangular prism. Of course, the invention is not to be so limited and other shapes are possible in accordance with the teachings and disclosure that follows. In the exemplified embodiment, the elastomeric member 370 is elongated in a direction that is transverse to the longitudinal axis B-B of the head, and thus the elastomeric member 370 spans across the width of the head 310. In other embodiments, the elastomeric member 370 may be elongated in a direction of the longitudinal axis B-B of the head 310, or at a non-perpendicular angle relative to the longitudinal axis B-B of the head 310. Furthermore, although in the exemplified embodiment the elastomeric member 370 is a single component, in other embodiments the elastomeric member 370 may be formed from several components that are spaced apart and positioned adjacent to one another.

In the exemplified embodiment, the elastomeric member 370 extends along a reference plane RP that intersects the front surface 312 of the head 310. In the exemplified embodiment, the reference plane RP is oriented substantially perpendicular to the longitudinal axis B-B of the head 310 and substantially perpendicular to the front surface 312 of the head 310. However, the invention is not to be so limited and in other embodiments the reference plane RP may be oriented substantially parallel to the longitudinal axis B-B (or the reference plane RP may even be coextensive with the longitudinal axis B-B).

The elastomeric member 370 has a first outer surface 371 and a second outer surface 372. Furthermore, each of the first and second outer surfaces 371, 372 of the elastomeric member 370 is inclined relative to the front surface 312 of the head 310 such that the first and second outer surfaces 371, 372 of the elastomeric member 370 converge toward the reference plane RP with increasing distance from the front surface 312 of the head 310. Stated another way, the elastomeric member 370 has a greater width measured at the front surface 312 of the head 310 than at its free end 373. More specifically, in the exemplified embodiment the width of the elastomeric member 370 gradually and continuously decreases with distance from the front surface 312 of the head 310 towards the free end 373 of the elastomeric member 370. It is this inclined/converging shape that results in the elastomeric member 370 being in the shape of a triangular prism in the exemplified embodiment. The angles of inclination of the outer surfaces 371, 372 can be any of the angles discussed above with regard to the elastomeric member 170 of the oral care implement 100.

The oral care implement 300 comprises a plurality of first inclined bristle tufts 350 and a plurality of second inclined bristle tufts 360. The plurality of first inclined bristle tufts 350 are arranged adjacent to the first outer surface 371 of the elastomeric member 370. In the exemplified embodiment, the plurality of first inclined bristle tufts 350 are spaced apart from the first outer surface 371 of the elastomeric member 370 by a gap, although the first inclined bristle tufts 350 may be in contact with the first outer surface 371 of the elastomeric member 370 in other embodiments. Furthermore, the plurality of first inclined bristle tufts 350 are angled relative to the front surface 312 of the head 310 at approximately the same angle as the first outer surface 371 of the elastomeric member 370.

The plurality of second inclined bristle tufts 360 are arranged adjacent to the second outer surface 372 of the elastomeric member 370. In the exemplified embodiment, the plurality of second inclined bristle tufts 360 are spaced apart from the second outer surface 372 of the elastomeric member 370 by a gap, although the second inclined bristle tufts 360 may be in contact with the second outer surface 372 of the elastomeric member 370 in other embodiments. Furthermore, the plurality of second inclined bristle tufts 360 are angled relative to the front surface 312 of the head 310 at approximately the same angle as the second outer surface 372 of the elastomeric member 370. Thus, each of the plurality of first inclined bristle tufts 350 extends from the front surface 312 of the head 310 so as to converge towards the reference plane RP with increasing distance from the front surface 312 of the head 310. Each of the plurality of second inclined bristle tufts 360 extends from the front surface 312 of the head 310 so as to converge towards the reference plane RP with increasing distance from the front surface 312 of the head 310.

Thus, the plurality of first inclined bristle tufts 350 and the plurality of second inclined bristle tufts 360 converge in a direction towards each other with increasing distance from the front surface 312 of the head 310. Stated another way, the plurality of first inclined bristle tufts 350 extend from a first end 351 that is inserted into the head 310 to a second free end 352. The plurality of second inclined bristle tufts 360 extend from a first end 361 that is inserted into the head 310 to a second free end 362. The plurality of first inclined bristle tufts 350 are spaced apart from the plurality of second inclined bristle tufts 360 a first distance $D_1$ at the first ends 351, 361 of the plurality of first and second inclined bristle tufts 350, 360. The plurality of first inclined bristle tufts 350 are spaced apart from the plurality of second inclined bristle tufts 360 a second distance $D_2$ at the free ends 352, 362 of the plurality of first and second inclined bristle tufts. The first distance $D_1$ is greater than the second distance $D_2$. Furthermore, in some embodiments the free ends 352, 362 of the plurality of first and second inclined bristle tufts 350, 360 may intersect, overlap, crisscross, or come into slight abutting contact with each other.

In the exemplified embodiment, the plurality of first inclined bristle tufts 350 are arranged along a first linear reference line $RL_1$ on the front surface 312 of the head 310. Furthermore, the free ends 352 of the plurality of first inclined bristle tufts 350 terminate along a third linear reference line $RL_3$. The plurality of second inclined bristle tufts 360 are arranged along a second linear reference line $RL_2$ on the front surface 312 of the head 310. Furthermore, the free ends 362 of the plurality of second inclined bristle tufts 360 terminate along a fourth linear reference line $RL_4$. In the exemplified embodiment, the first linear reference line $RL_1$ is parallel to the second linear reference line $RL_2$. Furthermore, in the exemplified embodiment the first and second linear reference lines $RL_1$, $RL_2$ are perpendicular to the longitudinal axis B-B of the head 310. However, the invention is not to be so limited and in alternative embodiments the first and second linear reference lines $RL_1$, $RL_2$ can be parallel to the longitudinal axis B-B of the head 310, or can be oriented at a non-parallel and non-perpendicular orientation relative to the longitudinal axis B-B of the head 310.

In the exemplified embodiment, the elastomeric member 370 terminates in a free end 373 at a first height $H_1$ above the front surface 312 of the head 310. Furthermore, the plurality of first and second inclined bristle tufts 350, 360 terminate in free ends 352, 362 at a second height $H_2$ above the front surface 312 of the head 310. In the exemplified embodiment, the second height $H_2$ is greater than the first height $H_1$. However, in other embodiments, as has been discussed above with regard to the oral care implement 100, the second height $H_2$ may be equal to or less than the first height $H_1$.

As noted above, the free ends 352 of the plurality of first inclined bristle tufts 350 terminate along a third linear reference line $RL_3$. The free ends 362 of the plurality of second inclined bristle tufts 360 terminate along a fourth linear reference line $RL_4$. Each of the third and fourth linear reference lines $RL_3$, $RL_4$ overly the elastomeric member 370. Stated another way, a plane extending downwardly from the third linear reference line $RL_3$ in the direction of the front surface 312 of the head 310 would intersect the elastomeric member 370. Similarly, a plane extending downwardly from the fourth linear reference line $RL_4$ in the direction of the front surface 312 of the head 310 would intersect the elastomeric member 370. This is possible because the distance $D_2$ between the free ends 352, 362 of the plurality of first and second bristle tufts 350, 360 is less than the greatest distance between the first and second outer surfaces 371, 372 of the elastomeric member 370 (the distance between the first and second outer surfaces 371, 372 of the elastomeric member 370 increases from the free end 373 of the elastomeric member 370 to the front surface 312 of the head 310).

Similar to the discussion above with regard to the plurality of inclined bristle tufts 150, various combinations of the different types of bristles can be used with each of the plurality of first and second inclined bristle tufts 350, 360. Notwithstanding the above, in the exemplified embodiment each of the plurality of first and second inclined bristle tufts 350, 360 comprises tapered bristles. Thus, in certain embodiments each of the plurality of first and second inclined bristle tufts 350, 360 includes at least some tapered bristles, although other bristles within each of the first and second inclined bristle tuft 350, 360 may be non-tapered. Furthermore, in still other embodiments each of the first and second inclined bristle tufts 350, 360 consist only of tapered bristles. Tapered bristles are bristles that taper to a pointed tip. The tapered bristles may taper along their entire length, or the tapered bristles may have a constant diameter for a first portion of their length and then taper for a second portion of their length. Tapering of the bristles can be achieved via mechanical grinding processes or via chemical dipping processes or a combination of the two.

In some embodiments, the invention may be directed to the positioning and orientation of the first and second inclined bristle tufts 350, 360 relative to the elastomeric member 370. Specifically, in certain embodiments the invention is directed to arranging the first inclined bristle tufts 350 on a first side of the elastomeric member 370 so as to be adjacent to the first outer surface 371 of the elastomeric member 370 and arranging the second inclined bristle tufts 360 on a second side of the elastomeric member 370 so as to be adjacent to the second outer surface 372 of the elastomeric member 370. In such an embodiment, as depicted in FIGS. 6 and 7, the first inclined bristle tufts 350 extend from the front surface 312 of the head 310 at an oblique angle towards the elastomeric member 370 and the second inclined bristle tufts 360 extend from the front surface 312 of the head 310 at an oblique angle towards the elastomeric member 370. Due to the positioning of the first and second inclined bristle tufts 350, 360 on opposite sides of the elastomeric member 370, the first and second inclined bristle tufts 350, 360 converge towards each other and towards the reference plane RP. Furthermore, the invention can be directed to an elastomeric member 370 having inclined outer surfaces and bristle tufts 350, 360 that are inclined being positioned adjacent to the outer surfaces of the elastomeric member 370.

Figure 8:
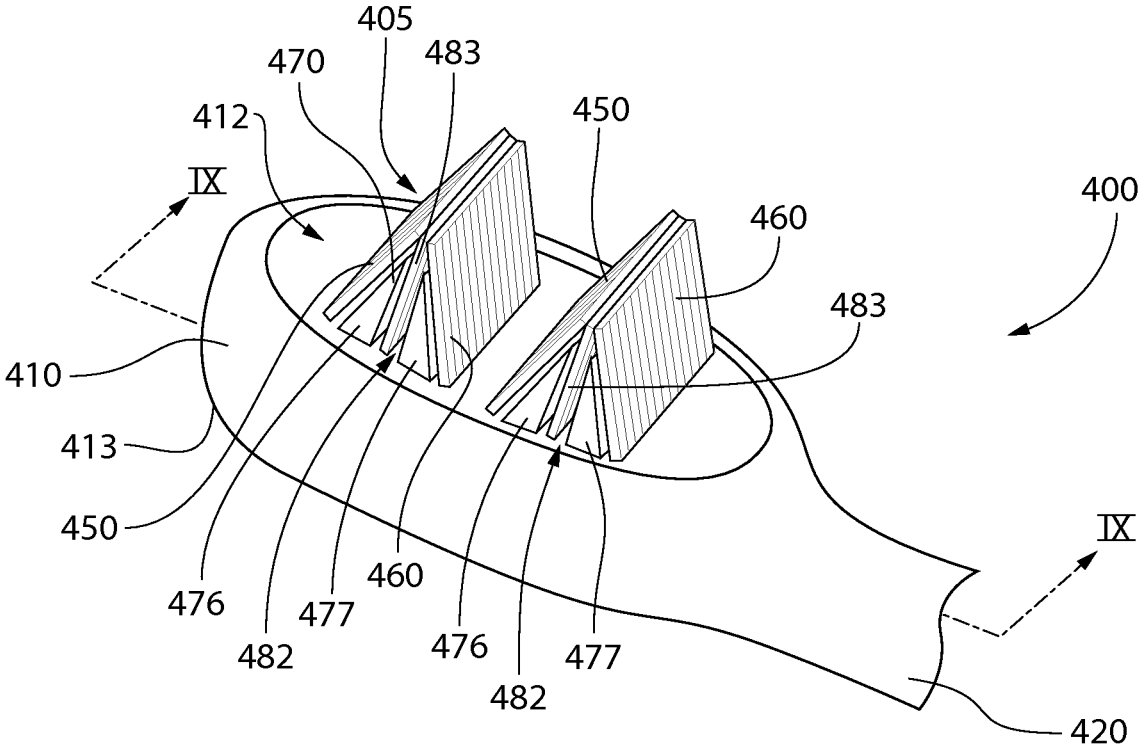
FIG. 8 is a close-up view of a head of an oral care implement in accordance with a fourth embodiment of the present invention.
Figure 9:
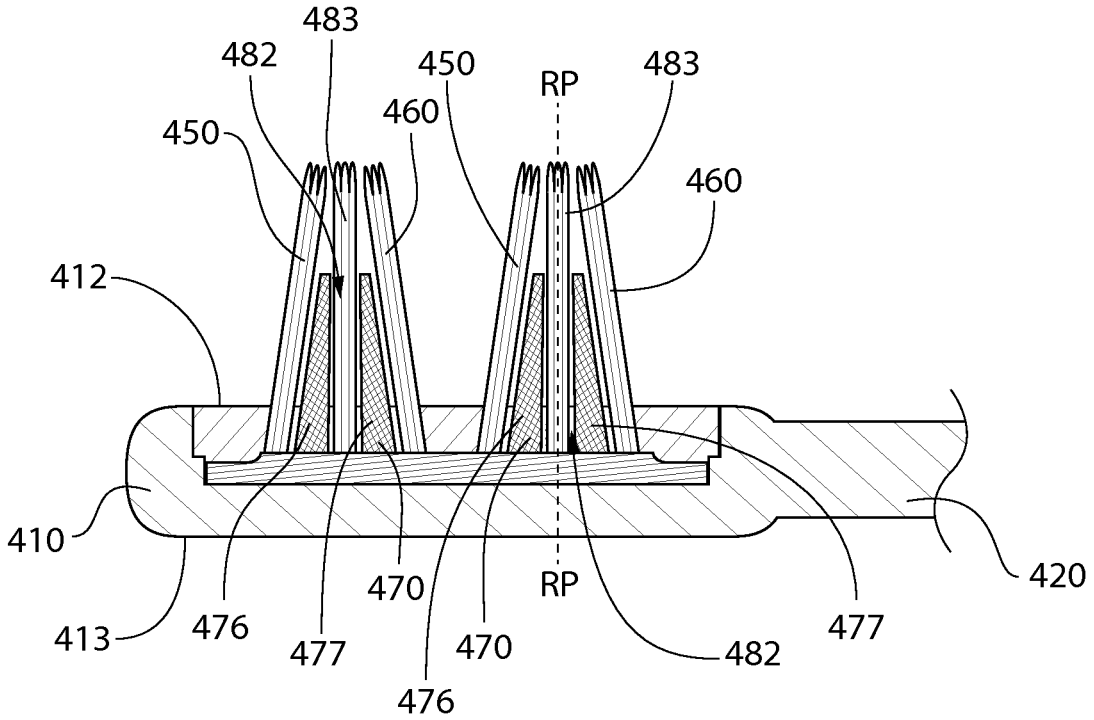
FIG. 9 is a cross-sectional view taken along line IX-IX of FIG. 8.

Referring now to FIGS. 8 and 9 concurrently, an oral care implement 400 will be described in accordance with a fourth embodiment of the present invention. The oral care implement 400 is similar to the oral care implements 100, 200, 300 and thus much of the description above with regard to the oral care implements 100, 200, 300 is applicable to the oral care implement 400, except where it is contradictory to a specific description of the oral care implement 400 provided below. Features of the oral care implement 400 that are similar to features of the oral care implements 100, 200, 300 described above will be similarly numbered except that the 400-series of numbers will be used. Certain features of the oral care implement 400 may be labeled but not described, in which case the description of the similar feature from the oral care implements 100, 200, 300 applies. Furthermore, certain features of the oral care implement 400 may not be labeled, it being understood that the description of the similar feature from the oral care implements 100, 200, 300 applies.

The oral care implement 400 generally comprises a head 410 and a handle 420. The head 410 has a front surface 412 and an opposing rear surface 413. Furthermore, a plurality of tooth cleaning elements 405 extend from the front surface 412 of the head 410. The plurality of tooth cleaning elements 405 comprises a plurality of first inclined bristles 450, a plurality of second inclined bristles 460, and an elastomeric member 470. The description provided above with regard to the material, type, positioning, orientation and the like of the inclined bristles 350 is equally applicable to the inclined bristles 450 and thus a duplicate description will not be provided herein.

Specifically, the oral care implement 400 is similar to the oral care implement 300 in all respects except that the elastomeric member 470 comprises a first component 476 and a second component 477. The first component 476 is separated from the second component 477 by a gap 482. Furthermore, the oral care implement 400 comprises at least one, and preferably a plurality of central cleaning elements 483 extending from the front surface 412 of the head 410 within the gap 482. Furthermore, the plurality of central cleaning elements 483 extend from the front surface 412 of the head 410 along the reference plane RP.

In the exemplified embodiment each of the plurality of first and second inclined bristle tufts 450, 460 are oriented at an oblique angle relative to the front surface 412 of the head 410 as discussed above. However, the plurality of central cleaning elements 483 are oriented perpendicularly relative to the front surface 412 of the head 410. This is because each of the first and second components 476, 477 of the elastomeric member 470 has an inner surface that is oriented perpendicular to the front surface 412 of the head 410. Of course, in other embodiments the inner surfaces of the first and second components 476, 477 of the elastomeric member 470 may be oriented at an angle relative to the front surface 412 of the head 410 and the plurality of central cleaning elements 483 may also be oriented at an oblique angle relative to the front surface 412 of the head 410.

In the exemplified embodiment, the plurality of central cleaning elements 483 are tufts of bristles. More specifically, the plurality of central cleaning elements 483 are tufts of tapered bristles. However, the invention is not to be so limited and the plurality of central cleaning elements 483 can be tufts of non-tapered bristles, combinations of tapered, non-tapered, spiral and the like bristles, or the plurality of central cleaning elements 483 may comprise elastomeric components or elements. Furthermore, in the exemplified embodiment the gap 482 is an elongated gap extending transverse to the longitudinal axis of the head 410. Furthermore, the plurality of central cleaning elements 483 extend across the entirety of the gap 482 along the width of the head 410. However, the invention is not to be so limited in all embodiments and the central cleaning elements 483 may extend across only portions of the gap 482 while leaving other portions of the gap 482 free of cleaning elements.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care implement comprising:

a head having a front surface;

a plurality of tooth cleaning elements comprising:

a plurality of inclined bristle tufts circumferentially arranged about a first reference ring on the front surface that surrounds a reference axis that intersects the front surface, each of the plurality of inclined bristle tufts extending from the front surface of the head so as to converge toward the reference axis with increasing distance from the front surface; and an elastomeric member extending from the front surface of the head at a position within the first reference ring;

wherein the elastomeric member has a conical shape.

2. The oral care implement according to claim 1 wherein the first reference ring comprises a first center point, the reference axis is perpendicular to the front surface, and the reference axis intersects the front surface at the first center point of the first reference ring.

3. The oral care implement according to claim 1 wherein the plurality of inclined bristle tufts terminate in free ends that collectively define a second reference ring.

4. The oral care implement according to claim 3 wherein the second reference ring overlies the elastomeric member.

5. The oral care implement according to claim 3 wherein the second reference ring comprises a second center point, the reference axis intersecting the second center point of the second reference ring.

6. The oral care implement according to claim 3 wherein the first reference ring has a first diameter and the second reference ring has a second diameter, the second diameter being less than the first diameter.

7. The oral care implement according to claim 1 wherein the elastomeric member terminates in a free end at a first height above the front surface; wherein the plurality of inclined bristle tufts terminate in free ends at a second height above the front surface; and wherein the second height is greater than the first height.

8. The oral care implement according to claim 1 wherein the elastomeric member comprises an inclined outer surface that converges toward the reference axis with increasing distance from the front surface.

9. The oral care implement according to claim 1 wherein an annular gap is formed between an outer surface of the elastomeric member and the plurality of inclined bristle tufts.

10. The oral care implement according to claim 1 wherein the elastomeric member comprises a first component and a second component, wherein a central gap is formed between the first and second components of the elastomeric member; and wherein the plurality of cleaning elements further comprises a central cleaning element extending from the front surface and located within the central gap.

11. The oral care implement according to claim 1 wherein the elastomeric member has a truncated conical shape terminating in a flattened top surface.

12. An oral care implement comprising:

a head having a front surface;

a plurality of tooth cleaning elements comprising:

an elastomeric member extending from the front surface of the head, the elastomeric member comprising a first component and a second component that are spaced apart from one another by a central gap;

a first inclined bristle tuft arranged on a first side of the elastomeric member, the first inclined bristle tuft extending from the front surface of the head at an oblique angle toward the elastomeric member;

a second inclined bristle tuft arranged on a second side of the elastomeric member opposite the first side, the second inclined bristle tuft extending from the front surface of the head at an oblique angle toward the elastomeric member; and a central cleaning element extending from the front surface of the head and located within the central gap.

* * * * *